US010638246B2

(12) United States Patent
Chen et al.

(10) Patent No.: US 10,638,246 B2
(45) Date of Patent: *Apr. 28, 2020

(54) AUDIO OBJECT EXTRACTION WITH SUB-BAND OBJECT PROBABILITY ESTIMATION

(71) Applicant: Dolby Laboratories Licensing Corporation, San Francisco, CA (US)

(72) Inventors: Lianwu Chen, Beijing (CN); Lie Lu, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 14 days.

This patent is subject to a terminal disclaimer.

(21) Appl. No.: 15/785,305

(22) Filed: Oct. 16, 2017

(65) Prior Publication Data

US 2018/0103333 A1 Apr. 12, 2018

Related U.S. Application Data

(63) Continuation of application No. 15/328,631, filed as application No. PCT/US2015/041765 on Jul. 23, 2015, now Pat. No. 9,820,077.

(Continued)

(30) Foreign Application Priority Data

Jul. 25, 2014 (CN) ..... 2014 1 0372867

(51) Int. Cl.

*H04S 7/00* (2006.01)
*G10L 21/0308* (2013.01)

(Continued)

(52) U.S. Cl.

CPC ..... *H04S 7/302* (2013.01); *G10L 21/0308* (2013.01); *G10L 21/038* (2013.01);

(Continued)

(58) Field of Classification Search

CPC ..... H04S 7/302; H04S 3/008; H04S 2400/01; H04S 2400/13; H04S 2420/07;

(Continued)

(56) References Cited

U.S. PATENT DOCUMENTS

2005/0086682 A1 4/2005 Burges
2011/0046759 A1* 2/2011 Kim ..... G10L 21/0272 700/94

(Continued)

FOREIGN PATENT DOCUMENTS

WO 2007/089131 8/2007
WO 2008/120933 10/2008

(Continued)

OTHER PUBLICATIONS

Koo, K. et al "Variable Subband Analysis for High Quality Spatial Audio Object Coding" IEEE 10th International Conference on Advanced Communication Technology, Feb. 17-20, 2008, pp. 1205-1208, vol. 2.

(Continued)

*Primary Examiner* — Sonia L Gay

(57) ABSTRACT

Embodiments of the example embodiment relate to audio object extraction. A method for audio object extraction from audio content is disclosed. The method comprises determining a sub-band object probability for a sub-band of the audio signal in a frame of the audio content, the sub-band object probability indicating a probability of the sub-band of the audio signal containing an audio object. The method further comprises splitting the sub-band of the audio signal into an audio object portion and a residual audio portion based on the determined sub-band object probability. Corresponding system and computer program product are also disclosed.

13 Claims, 4 Drawing Sheets

Related U.S. Application Data

(60) Provisional application No. 62/037,748, filed on Aug. 15, 2014.

(51) Int. Cl.
*G10L 21/038* (2013.01)
*H04S 3/00* (2006.01)
*G10L 19/008* (2013.01)

(52) U.S. Cl.
CPC ..... *H04S 3/008* (2013.01); *G10L 19/008* (2013.01); *H04S 2400/01* (2013.01); *H04S 2400/11* (2013.01); *H04S 2400/13* (2013.01); *H04S 2420/07* (2013.01)

(58) Field of Classification Search
CPC ..... H04S 2400/11; G10L 21/038; G10L 21/0308; G10L 19/008
See application file for complete search history.

(56) References Cited

U.S. PATENT DOCUMENTS

2012/0224702 A1* 9/2012 Den Brinker ..... G10L 19/008 381/22
2015/0098571 A1* 4/2015 Jarvinen ..... H04S 7/301 381/1
2015/0245158 A1* 8/2015 Vilermo ..... H04S 7/302 381/303
2015/0332680 A1 11/2015 Crockett
2016/0150343 A1 5/2016 Wang
2016/0267914 A1 9/2016 Hu
2016/0337776 A1 11/2016 Breebaart

FOREIGN PATENT DOCUMENTS

WO 2009/048239 4/2009
WO 2014/053547 4/2014

OTHER PUBLICATIONS

Mandel, M. et al "Model-Based Expectation Maximization Source Separation and Localization" IEEE Transactions on Audio, Speech and Language Processing, New York, USA, vol. 18, No. 2, Feb. 1, 2010, pp. 382-394.
Smaragdis, R et al "Separation by "Humming": User-Guided Sound Extraction from Monophonic Mixtures" IEEE Workshop on Applications of Signal Processing to Audio and Acoustics, Oct. 18, 2009, pp. 69-72.

* cited by examiner

AUDIO OBJECT EXTRACTION WITH SUB-BAND OBJECT PROBABILITY ESTIMATION

CROSS-REFERENCE TO RELATED APPLICATIONS

This application is a continuation of U.S. application Ser. No. 15/328,631, filed on Jan. 24, 2017, which is a National Stage Entry of PCT Application Ser. No. PCT/US2015/041765, filed on Jul. 23, 2015, which claims benefit of priority to U.S. Provisional Application Ser. No. 62/037,748, filed on Aug. 15, 2014, and also claims priority to Chinese Patent Application Ser. No. 201410372867.X, filed on Jul. 25, 2014. The entire contents of each of the foregoing is hereby incorporated by reference.

TECHNOLOGY

Example embodiments disclosed herein generally relate to audio content processing, and more specifically, to a method and system for audio object extraction with sub-band object probability estimation.

BACKGROUND

Traditionally, audio content is created and stored in channel-based formats. As used herein, the term "audio channel" or "channel" refers to the audio content that usually has a predefined physical location. For example, stereo, surround 5.1, surround 7.1 and the like are all channel-based formats for audio content. Recently, with the development in the multimedia industry, three-dimensional (3D) audio content is getting more and more popular in cinema and home. In order to create a more immersive sound field and to control discrete audio elements accurately, irrespective of specific playback speaker configurations, many conventional playback systems need to be extended to support a new format of audio that includes both the audio channels and audio objects.

As used herein, the term "audio object" refers to an individual audio element that exists for a defined duration of time in the sound field. An audio object may be dynamic or static. For example, an audio object may be human, animal or any other object serving as a sound source in the sound field. Optionally, the audio objects may have associated metadata, such as the information describing the position, velocity, and the size of an object. Use of the audio objects enables the audio content to have high immersive listening experience, while allowing an operator, such as an audio mixer, to control and adjust audio objects in a convenient manner. During transmission, the audio objects and channels can be sent separately, and then used by a reproduction system on the fly to recreate the artistic intention adaptively based on the configuration of playback speakers. As an example, in a format known as "adaptive audio content," there may be one or more audio objects and one or more "audio beds". As used herein, the term "audio beds" or "beds" refers to audio channels that are meant to be reproduced in pre-defined, fixed locations.

In general, object-based audio content is generated in a quite different way from the traditional channel-based audio content. Although the new object-based format allows creation of more immersive listening experience with the aid of audio objects, the channel-based audio format, especially the final-mixing audio format, still prevails in movie sound ecosystem, for example, in the chains of sound creation, distribution and consumption. As a result, given traditional channel-based content, in order to provide end users with similar immersive experiences as provided by the audio objects, there is a need to extract audio objects from the traditional channel-based content.

SUMMARY

In order to address the foregoing and other potential problems, example embodiments disclosed herein proposes a method and system for extracting audio objects from audio content.

In one aspect, example embodiments disclosed herein provide a method for audio object extraction from audio content. The method includes determining a sub-band object probability for a sub-band of an audio signal in a frame of the audio content, the sub-band object probability indicating a probability of the sub-band of the audio signal containing an audio object. The method further includes dividing the sub-band of the audio signal into an audio object portion and a residual audio portion based on the determined sub-band object probability. Embodiments in this regard further include a corresponding computer program product.

In another aspect, example embodiments disclosed herein provide a system for audio object extraction from audio content. The system includes a probability determining unit configured to determine a sub-band object probability for a sub-band of an audio signal in a frame of the audio content, the sub-band object probability indicating a probability of the sub-band of the audio signal containing an audio object. The system further includes an audio dividing unit configured to divide the sub-band of the audio signal into an audio object portion and a residual audio portion based on the determined sub-band object probability.

Through the following description, it would be appreciated that in accordance with example embodiments disclosed herein, the sub-bands of audio signal can be softly divided into the audio object portion and the residual audio portion. In this way, the instability in the regenerated audio content by the divided audio object portions and the residual audio portions can be better prevented. Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
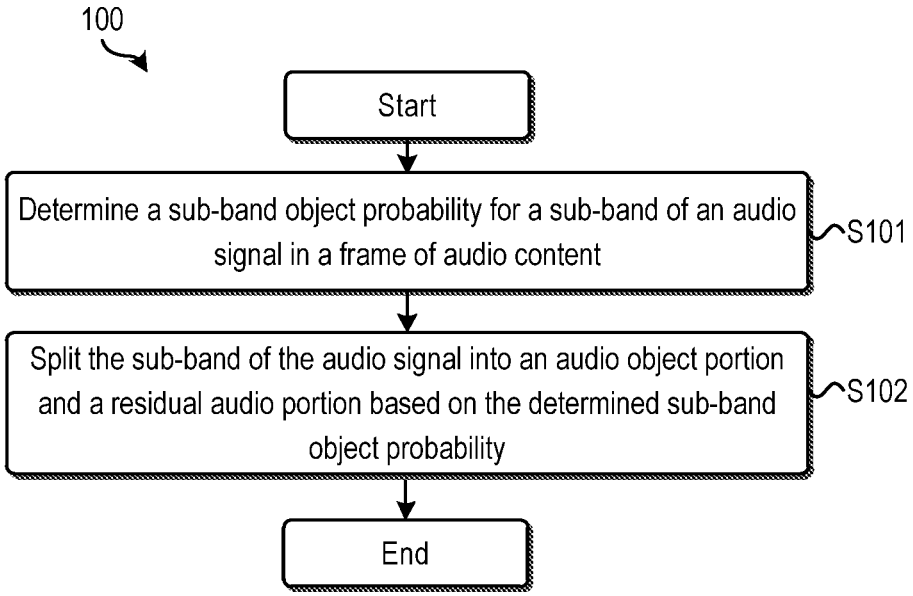
FIG. 1 illustrates a flowchart of a method for audio object extraction from audio content in accordance with an example embodiment.

Principles of the example embodiments will now be described with reference to various example embodiments illustrated in the drawings. It should be appreciated that the depiction of these embodiments is only to enable those skilled in the art to better understand and further implement the example embodiments disclosed herein, not intended for limiting the scope in any manner.

As mentioned above, it is desired to extract audio objects from audio content. The developed channel-grouping based method typically works well on multi-channel pre-dubs and stems which usually contain only one audio object in each channel. As used herein, the term "pre-dub" refers to the channel-based audio content prior to being combined with other pre-dubs to produce a stem. The term "stem" refers to the channel-based audio content prior to being combined with other stems to produce a final mix. Examples of such a type of content comprise dialogue stems, sound effect stems, music stems, and the forth. For these kinds of audio content, there are few cases in which audio objects are overlapped within channels. The channel-grouping based method is appropriate to be used in the reauthoring or content creation use cases where pre-dubs and stems are available and audio mixers can further manipulate the audio objects, such as editing, deleting, or merging the audio objects, or modifying their positions, trajectories or other metadata. However, the above-presented method is not purposely designed (and may not work well) for another use case where more complex multi-channel final-mix may be considered and be automatically up-mixed from 2D to 3D to create 3D audio experience through the object extraction. Moreover, in multi-channel final-mixing, multiple sources are usually mixed together in one channel. Thus, the automatically extracted objects may contain more than one actual audio object, which may further make its position determination incorrect. If source separation algorithms are applied to separate the mixed sources, for example, extracting individual audio objects from audio content, the extracted audio objects may have audible artifacts, causing an instability problem.

In order to address the above and other potential problems, example embodiments disclosed herein propose a method and system for audio object extraction in a soft manner. Each sub-band of each frame (that is, each spectral-temporal tile) of audio is analyzed and softly assigned to an audio object portion and an audio bed (residual audio) portion. Compared with a hard decision scheme, where one spectral-temporal tile is extracted as an audio object in the current frame and extracted as residual audio in the next frame or vice versa, causing the audible switching artifacts at this transition point, the soft-decision scheme of the example embodiments can minimize the switching artifact.

Reference is first made to FIG. 1 which shows a flowchart of a method 100 for audio object extraction from audio content in accordance with example embodiments. The input audio content may be of a format based on a plurality of channels or a singular channel. For example, the input audio content may conform to stereo, surround 5.1, surround 7.1, or the like. In some embodiments, the audio content may be represented as a frequency domain signal. Alternatively, the audio content may be input as a time domain signal. For example, in those embodiments where the time domain audio signal is input, it may be necessary to perform some preprocessing to obtain corresponding frequency signal.

At S101, a sub-band object probability is determined for a sub-band of the audio signal in a frame of the audio content. The sub-band object probability indicates a probability of the sub-band of the audio signal containing an audio object.

A frame is a processing unit for audio content, and the duration of a frame may be varied and may be depend on the configuration of the audio processing system. In some embodiments, a frame of audio content is converted into multiple filter band signals using a time-frequency transform such as conjugated quadrature mirror filterbanks (CQMF), Fast Fourier Transform (FFT), or the like. For a frame, its full frequency range may be divided into a plurality of frequency sub-bands, each of which occupies a predefined frequency range. For example, for a frame with a frequency range from 0 Hz to 24 kHz, a sub-band may occupy a frequency range of 400 Hz. In embodiments of the present embodiments, the plurality of sub-bands may have the same or different frequency range. The scope of the example embodiments is not limited in this regard.

The division of the whole frequency band into multiple frequency sub-bands is based on the observation that when different audio objects overlap within channels, they are not likely to overlap in all of the sub-bands due to the well-known sparsity property of most of the audio signals and thereby, it is much more reasonable to assume that each sub-band contains one dominant source at each time. Accordingly, the following processing of audio object extraction can be performed on a sub-band of the audio signal.

For audio content in traditional format, such as the final-mix multichannel audio, directly extracting each sub-band of the audio signal as an audio object might introduce some audible artifacts, especially in some "bad" cases, for example, where the sparsity assumption that the sub-band only contains one dominant object is not satisfied; or where some sub-bands are not suitable to be extracted as audio objects from the artistic point of view; or where some sub-bands are difficult to be rendered to a specific position by the renderer after being extracted as objects. In some cases, the sparsity assumption might not be satisfied since multiple sources (ambience, and/or objects from different spatial positions) might be mixed together in different sub-bands with different proportions. One example case is that two different objects, one in the left channel and the other in the right channel, are mixed in one sub-band. In this case, if the sub-band is extracted as an audio object, the two different objects will be processed as one object and rendered to the center channel, which will introduce audible artifacts.

Therefore, in order to extract sub-band objects from the input audio content without introducing audible artifacts, the sub-band object probability is proposed in example embodiments disclosed herein to indicate whether the sub-band is suitable to be extracted as an audio object or not. More specifically, the sub-band object probability is to avoid extracting audio objects in sub-bands in the "bad" cases discussed above. To this end, each sub-band of the audio signal is analyzed and the sub-band object probability is determined at this step. Based on the determined sub-band object probability, the sub-band of the audio signal will be assigned as an audio object portion and a residual audio portion in a soft manner.

For each "bad" case of object extraction, there may be one or more factors/clues associated with it. For example, when two different objects exist in one sub-band, the channel correlation of the sub-band would be low. Therefore, in some example embodiments disclosed herein, several factors, for example, a spatial position of the sub-band, channel correlation, panning rules and/or frequency range of the sub-band may be considered separately or jointly in sub-band object probability determination, which will be described below in more details.

At S102, the sub-band of the audio signal is split into an audio object portion and a residual audio portion based on the determined sub-band object probability. In this step, the sub-band of the audio signal may not be determined as either an audio object or an audio bed exactly, but may be split into an audio object portion and a residual audio/audio bed portion in a soft manner based on the sub-band object probability. In example embodiments disclosed herein, one audio object portion may not exactly contain one so-called audio object, such as a sound of a person, an animal or a thunder, but contain a portion of the sub-band of the audio signal that may be viewed as an audio object. In some embodiments, the audio object portion may then be rendered to estimate spatial position and the residual audio portions may then be rendered as bed channels in an adaptive audio content processing.

One of the advantages of soft audio object extraction is to avoid the switching artifact between audio object rendering and channel-based rendering that may be caused by a hard decision as well as the audio instability. For example, with a hard decision scheme, if one sub-band is extracted as an audio object in the current frame and extracted as an audio bed in the next frame, or vice versa, the switching artifacts may be audible at this transition point. However, with the soft-decision scheme of the example embodiments, part of the sub-band is extracted as an object and the other part of the sub-band remains in audio beds, and the switching artifact may be minimized.

In the processing illustrated in FIG. 1, one sub-band of the audio signal is softly split into an audio object portion and a residual audio portion. A frame of the input audio content may be divided into a plurality of sub-bands of audio signal in a frequency domain. For each of the plurality of sub-bands of audio signal, the processing as illustrated in FIG. 1 may be performed to softly split the sub-bands of audio signal. For audio content having multiple frames, each frame may be divided in the frequency domain, and each divided sub-band may be softly split in some embodiments. It should be noted that, in some other embodiments, not all frames of the input audio content or not all divided multiple sub-bands are processed in a soft manner discussed above. The scope of the example embodiments is not limited in this regard.

Figure 2:
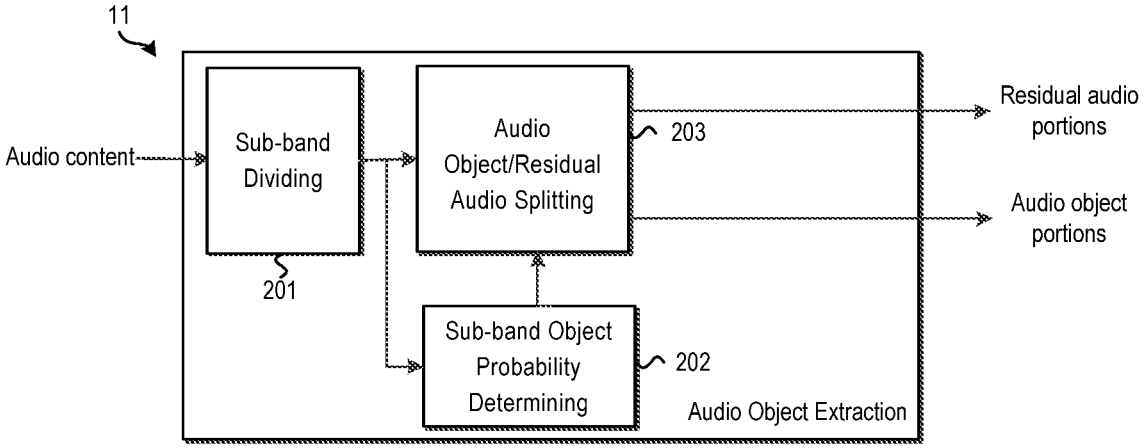
FIG. 2 illustrates a block diagram for audio object extraction in accordance with an example embodiment.

With reference to FIG. 2, a block diagram for audio object extraction is illustrated in accordance with an example embodiment. In FIG. 2, the block of sub-bands dividing 201 may be configured to divide a frame of the input audio content into a plurality of sub-bands of audio signal. The determination of sub-band object probability, as discussed with respect to step S101 of the method 100, may be performed in the block of sub-band object probability determining 202 with the output sub-band of the audio signal from the block 201. The splitting of the audio object portion and residual audio portion, as discussed with respect to step S102 of the method 100, may be performed in the block of audio object/residual audio splitting 203 with the output of the blocks 201 and 202. The output of the block 203 is residual audio portions, which may be used as audio beds, and audio object portions, both of which may be used to generate the adaptive audio content in later processing in some embodiments.

Figure 3:
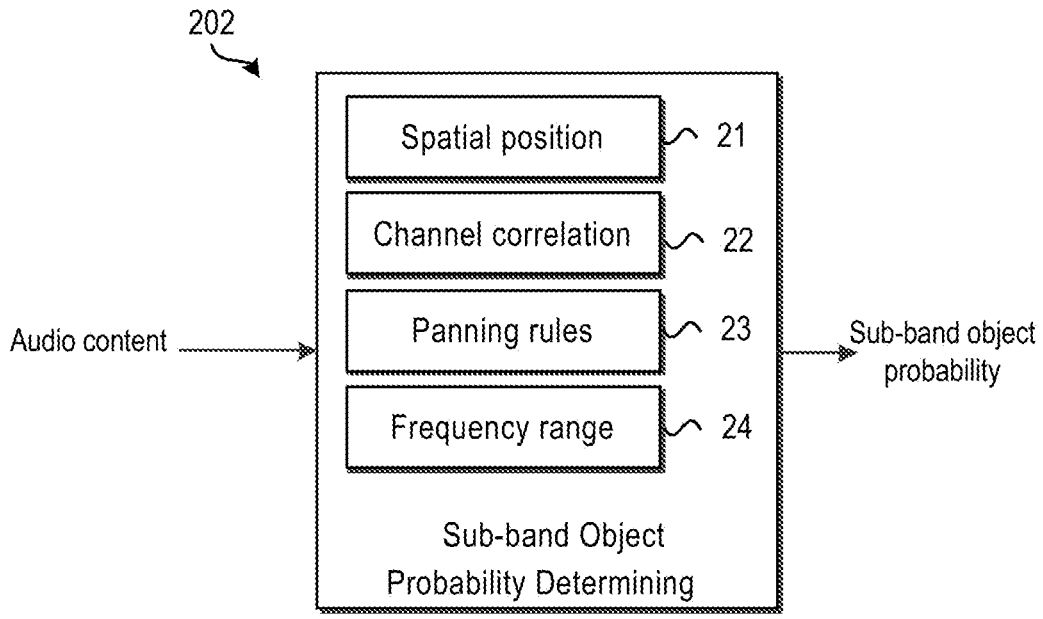
FIG. 3 illustrates a block diagram for sub-band object probability determining in accordance with an example embodiment.

The block of sub-band object probability determining 202 of FIG. 2 will be discussed below with reference to FIG. 3. As stated above, in some example embodiments disclosed herein, several factors, such as a spatial position of the sub-band, channel correlation, panning rules and/or frequency range of the sub-band, may be considered in sub-band object probability determination. In some examples, only one of the above-mentioned factors is taken into account. In some other examples, two or more of the above-mentioned factors are taken into account in combination. In cases where some factor is not considered in sub-band object probability determination, the corresponding block shown in FIG. 3 may be omitted. It is noted that other factors may also be considered when determining the sub-band object probability, and the scope of the example embodiments is not limited in this regard.

With respect to the factors having impact on the sub-band object probability, according to some example embodiments disclosed herein, the determination of the sub-band object probability for the sub-band of the audio signal in step S101 of the method 100 may comprise determining the sub-band object probability based on at least one of: a first probability determined based on a spatial position of the sub-band of the audio signal; a second probability determined based on correlation between multiple channels of the sub-band of the audio signal when the audio content is of a format based on multiple-channels; a third probability determined based on at least one panning rule in audio mixing; and a fourth probability determined based on a frequency range of the sub-band of the audio signal.

The determination of the first, second, third, and fourth probabilities will be respectively discussed below.

The First Probability Based on Spatial Position

As known, in order to enhance spatial perception in audio processing, audio objects are usually rendered into different spatial positions by audio mixers. As a result, in traditional channel-based audio contents, spatially-different audio objects are usually panned into different sets of channels with different energy portions.

When an audio object is panned into multiple channels, the sub-bands where the audio object exists would have the same energy distribution across multiple channels as well as the same determined spatial position. Correspondingly, if several sub-bands are at the same or close position, there may be a high probability that these sub-bands belong to the same object. On the contrary, if the sub-bands are distributed sparsely, their sub-band objects probability may be low, since these sub-bands are probably the mixture of different objects or ambience.

Figure 4A:
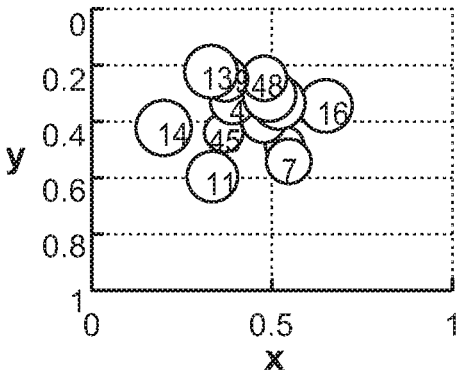
FIGS. 4A and 4B schematically show spatial positions of sub-bands in accordance with an example embodiment.
Figure 4B:
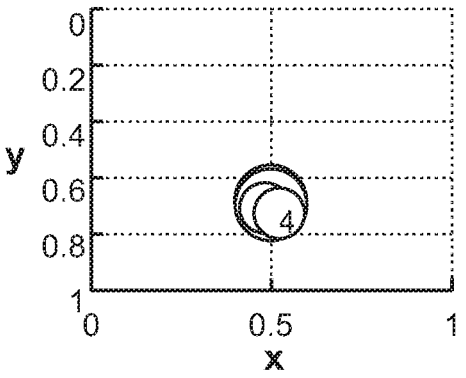

For example, two different cases of spatial position distribution of the sub-bands are shown in FIGS. 4A and 4B, where the dot with number i represents the $i^{th}$ sub-band, x and y indicate the 2D spatial position. FIG. 4A illustrates the sub-band spatial position of a rainy ambience sound. In this case, since the rainy sound is an ambience sound without direction, the sub-bands are distributing sparsely. If these sub-bands are extracted as audio objects, instability artifacts may be perceived. FIG. 4B illustrates the sub-band spatial position of thunder sound. In this case, all sub-bands are closely located in the same position, and by extracting these sub-bands as objects and rendering them to the determined position, more immersive listening experience may be created.

In view of the above, the spatial position of the sub-band of the audio signal may be used as a factor to determine the sub-band object probability, and a first probability based spatial position may be determined. In some example embodiments, to calculate the first probability determined based on a spatial position of the sub-band of the audio signal, the following steps may be performed: obtaining spatial positions of the plurality of sub-bands of the audio signal in the frame of the audio content; determining a sub-band density around the spatial position of the sub-band of the audio signal according to the obtained spatial positions of the plurality of sub-bands of audio signal; and determining the first probability for the sub-band of the audio signal based on the sub-band density. As discussed above, the first probability may be positively correlated with the sub-band density. That is, the higher the sub-band density is, the higher the first probability is. The first probability is in a range from 0 to 1.

There may be many ways to obtain spatial positions of the plurality of sub-bands of audio signal, for example, an energy weighting based method, or a loudness weighting based method. In some embodiments, clues or information provided by a human user may be used to determine spatial positions of the plurality of sub-bands of audio signal. The scope of the example embodiments disclosed herein are not limited in this regard. In one embodiment, spatial position determination using the energy weighting based method is presented as follows as an example:

$$p_i = \frac{\sum_{m=1}^{M} (e_{im} * P_m)}{\sum_{m=1}^{M} e_{im}} \tag{1}$$

where $p_i$ represents the spatial position of the $i^{th}$ sub-band in the processing frame; $e_{im}$ represents the energy of the $m^{th}$ channel of the $i^{th}$ sub-band; $P_m$ represents the predefined spatial position of the $m^{th}$ channel in the playback place; and M represents the number of channels.

Usually the speakers of corresponding channels are deployed at a predefined position in a playback place, such as a TV room, or a cinema. $P_m$ may be the spatial position of the speaker of the $m^{th}$ channel in one embodiment. If the input audio content is of a format based on a singular channel, $P_m$ may be the position of the single channel. In cases where the deployment of channels is not clearly known, $P_m$ may be a predefined position of the $m^{th}$ channel.

As discussed above, the sub-band object probability of a sub-band may be high if there are many sub-bands nearby, and it may be low if it is spatially sparse. From this point of view, the first probability may be positively correlated with the sub-band density and may be calculated as a monotonically increasing function of sub-band density. In one embodiment, a sigmoid function may be used to represent the relation between the first probability and the sub-band density, and the first probability may be calculated as follows:

$$prob_1(i) = \frac{1}{1 + e^{a_D * D_i + b_D}} \tag{2}$$

Where $prob_1(i)$ represents the first probability of the $i^{th}$ sub-band; $e^{a_D * D_i + b_D}$ represents an exponent function; $D_i$ represents the sub-band density around the spatial position of the $i^{th}$ sub-band; and $a_D$ and $b_D$ represent the parameters of the sigmoid function to map the sub-band density to the first probability. Typically, $a_D$ is negative, and then the first probability $prob_1(i)$ may be higher as the sub-band density $D_i$ becomes higher. In some embodiments, $a_D$ and $b_D$ may be predetermined and respectively remain the same value for different magnitude of sub-band density. In some other embodiments, $a_D$ and $b_D$ may be respectively a function of the sub-band density. For example, for different magnitude ranges of sub-band density, $a_D$ and $b_D$ may have different values.

It should be noted that there are many other ways to determine the first probability based on the sub-band density, as long as the first probability is positively correlated with the sub-band density. The scope of the example embodiment is not limited in this regard. For example, the first probability and the sub-band density may satisfy a linear relation. For another example, different ranges of sub-band density may correspond to linear functions with different slopes when determining the first probability. That is, the relation between the first probability and the sub-band density may be represented as a broken line, having several segments with different slopes. In any case, the first probability is in a range from 0 to 1.

Various approaches may be used here to estimate the sub-band density, including but not limited to a histogram based method, a kernel density determination method and a range of data clustering technique. The scope of the example embodiment is not limited in this regard. In one embodiment, the kernel density determination method is described as an example to estimate the sub-band density $D_i$ as follows:

$$D_i = \sum_{j=1}^{N} k(p_i, p_j) \tag{3}$$

Where N represents the number of sub-bands; $p_i$ and $p_j$ represent the spatial positions of the $i^{th}$ and $j^{th}$ sub-bands; and $k(p_i,p_j)$ represents a kernel function that is equal to 1 if the $i^{th}$ sub-band and the $j^{th}$ sub-band are at the same position. The value of $k(p_i,p_j)$ is decreasing to 0 with the spatial distance between the $i^{th}$ and $j^{th}$ sub-bands increasing. In other words, the function $k(p_i,p_j)$ represents the density distribution as a function of spatial distance between the $i^{th}$ and $j^{th}$ sub-bands.

The Second Probability Based on Channel Correlation

To determine whether a spectral-temporal tile (a sub-band of the audio signal) is suitable to be extracted as an audio object and rendered to a specific position, another factor that may be used is the channel correlation. In this case, the input audio content may be of a format based on a plurality of channels. For each multichannel spectral-temporal tile, if it contains one dominant object, the correlation value between multiple channels may be high. On the contrary, the correlation value may be low if it contains large amounts of ambience or more than one object. Since the extracted sub-band object will be further down-mixed into mono-audio object for object-based rendering, low correlation among channels may cause a great challenge to the down-mixer and obviously a timber change may be perceived after down-mixing. Therefore, the correlation between different channels may be used as a factor to estimate the sub-band object probability, and a second probability based on channel correlation may be determined.

In some embodiments of the example embodiments, to calculate the second probability based on the correlation between multiple channels of the sub-band of the audio signal when the audio content is of a format based on multiple-channels, the following steps may be performed: determining a degree of correlation between each two of the multiple channels for the sub-band of the audio signal; obtaining a total degree of correlation between the multiple channels of the sub-band of the audio signal based on the determined degree of correlation; and determining the second probability for the sub-band of the audio signal based on the total degree of correlation. As discussed above, the second probability may be positively correlated with the total degree of correlation. That is, the higher the total degree of correlation is, the higher the second probability is. The second probability is in a range from 0 to 1.

There may be many ways to estimate the degree of correlation between multiple channels, for example, an energy weighted channel correlation based method, a loudness weighted channel correlation based method. The scope of the example embodiment is not limited in this regard. In one embodiment, the correlation determination using the energy weighted based method is presented as follows as an example:

$$C_i = \frac{\sum_{n=1}^{M}\sum_{m=1}^{M}\sqrt{e_{in}} * \sqrt{e_{im}} * corr(\vec{x}_{in}, \vec{x}_{im})}{\sum_{n=1}^{M}\sum_{m=1}^{M}\sqrt{e_{in}} * \sqrt{e_{im}}} \quad (4)$$

Where $C_i$ represents the total degree of correlation between multiple channels; $\vec{x}_{in}$ represents the temporal sequence of audio signal of the $n^{th}$ channel of the $i^{th}$ sub-band in the processing frame; $\vec{x}_{im}$ represents the temporal sequence of audio signal of the $m^{th}$ channel of the $i^{th}$ sub-band in the processing frame; M represents the number of channels; $e_{in}$ represents the energy of the $n^{th}$ channel of the $i^{th}$ sub-band; $e_{im}$ represents the energy of the $m^{th}$ channel of the $i^{th}$ sub-band; and $corr(\vec{x}_{in}, \vec{x}_{im})$ represents the degree of correlation between two channels, the $n^{th}$ channel and the $m^{th}$ channel, of the $i^{th}$ sub-band. The value of $corr(\vec{x}_{in}, \vec{x}_{im})$ may be determined as the correlation/similarity between the two temporal sequences of audio signal $\vec{x}_{in}$ and $\vec{x}_{im}$.

As discussed above, the second probability based on channel correlation may be positively correlated with the total degree of correlation. In one embodiment, similar to the position distribution based probability, a sigmoid function may be used to represent the relation between the second probability and the total degree of correlation, and the second probability may be calculated as follows:

$$prob_2(i) = \frac{1}{1 + e^{a_c * C_i + b_c}} \quad (5)$$

Where $prob_2(i)$ represents the second probability of the $i^{th}$ sub-band; $e^{a_c * C_i + b_c}$ represents an exponent function; $C_i$ represents the total degree of correlation of the $i^{th}$ sub-band of the audio signal; and $a_c$ and $b_c$ represent the parameters of the sigmoid function to map the total degree of correlation to the second probability. Typically, $a_c$ is negative, and then the second probability $prob_2(i)$ may be higher as the total degree of correlation $C_i$ becomes higher. In some embodiments, $a_c$ and $b_c$ may be predetermined and respectively remain the same value for different degrees of correlation. In some other embodiments, $a_c$ and $b_c$ may be respectively a function of the degree of correlation. For example, for different ranges of degree of correlation, $a_c$ and $b_c$ may have different values.

It should be noted that there are many other ways to determine the second probability based on the total degree of correlation, as long as the second probability is positively correlated with the total degree of correlation. The scope of the example embodiment is not limited in this regard. For example, the second probability and the total degree of correlation may satisfy a linear relation. For another example, different degrees of correlation may correspond to linear functions with different slopes when determining the second probability. That is, the relation between the second probability and the total degree of correlation may be represented as a broken line, having several segments with different slopes. In any case, the second probability is in a range from 0 to 1.

The Third Probability Based on Panning Rules

Although the extracted audio objects may be used to enhance the listening experience by rendering the audio objects with determined positions in adaptive audio content generation, it sometimes may violate the artistic intention of the content creator, such as an audio mixer, which is a great challenge for publishing the generated adaptive audio content to consumers. For example, audio mixer might pan an object into both the left channel and the right channel with same energy to create a wide central sound image, directly extracting this sound signal as object and rendering to the center channel might make the sound not as wide as the audio mixer intended. Therefore, the artistic intention of content creator may be taken into consideration during the audio object extraction, to avoid undesirable intention violation.

Audio mixers usually realize their artistic intention by panning audio objects/sources with specific panning rules. Therefore, to preserve the artistic intention of content creator during the audio object extraction, it is reasonable to understand what kinds of sub-bands are created with special artistic intention (and with specific panning rules). For sub-bands with special panning rules, they are undesirable to be extracted as objects.

In some example embodiments, the following panning rules in original audio mixing may be considered during the object extraction.

Sub-bands of the audio signal with untypical energy distributions. Here, the "untypical" energy distribution is the distribution different from those generated by traditional panning methods. For example, in traditional panning methods, an object may always be panned into the nearby channels. For example, supposing there is an object in front center of the room, traditional panning methods always pan this object in the center channel; meanwhile, if a case where an object is panned to both the left and right channels with the same energy occurs, which the traditional panning methods may not do, it may indicate that there are some special artistic intentions needed to be preserved, and the corresponding sub-band of the audio signal may not be extracted as an object for the sake of preserving the special artistic intention.

Sub-bands of audio signal located at or close to the center channel. Audio mixers usually prefer to pan some important sound into the center channel, like dialog. In this context, it may be more appropriate to preserve the sound in the center channel and extract it as an audio bed, since extracting it as an object may result in some bias or shift off the center channel in audio content reproduction.

It should be noted that besides the above two panning rules, there may be other panning rules that should be taken into account during the audio object extraction. The scope of the example embodiment is not limited in this regard.

In some example embodiments, to calculate the third probability determined based on at least one panning rule in audio mixing, the following steps may be performed: determining for the sub-band of the audio signal a degree of association with each of the at least one panning rules in audio mixing, each panning rule indicating a condition where a sub-band of the audio signal is unsuitable to be an audio object; and determining the third probability for the sub-band of the audio signal based on the determined degree of association. As discussed above, the panning rules may generally indicate the cases where the sub-bands of audio signal may not be extracted as audio objects in order to avoid destroying the special artistic intention in audio mixing. As a result, the third probability may negatively be correlated with the total degree of association with the panning rules. That is, the higher the total degree of association with the panning rules is, the lower the third probability is. The third probability is in a range from 0 to 1.

Suppose there are K panning rules, each of which indicates a case in which the sub-band of the audio signal may not be suitable to be extracted as object from the artistic intention preservation point of view. In one embodiment, the third probability based on panning rules for each sub-band could be determined as follows:

$$prob_3(i) = \prod_{k=1}^{K} (1 - q_k(i)) \tag{6}$$

Where $prob_3(i)$ represents the third probability of the $i^{th}$ sub-band; and $q_k$ (i) represents the degree that the $i^{th}$ sub-band is associated with the $k^{th}$ panning rule. Therefore, the third probability may be high if the sub-band is not associated with any specific panning rules, and it may be low if the sub-band is associated with one specific panning rule. In some embodiments, if the $i^{th}$ sub-band is totally associated with the $k^{th}$ panning rule, $q_k$ (i) is 1; and if not, $q_k$ (i) is 0. In other embodiments, the degree of association with the $k^{th}$ panning rule may be determined, the value of which may vary from 0 to 1.

In some other embodiments, the at least one panning rule may include at least one of: a rule based on untypical energy distribution and a rule based on vicinity to a center channel. The rule based on untypical energy distribution and the rule based on vicinity to a center channel is respectively corresponding to the two panning rules discussed above. Sub-bands associated with any of the two rules may be considered as undesirable to be extracted as objects.

In some embodiments, the determination of the degree of association with the rule based on untypical energy distribution may comprise: determining the degree of association with the rule based on untypical energy distribution according to a first distance between an actual energy distribution and an estimated typical energy distribution of the sub-band of the audio signal. In an example embodiment, the degree of association with the rule based on untypical energy distribution may be represented as a probability, and may be defined as below:

$$q_2(i) = \frac{1}{1 + e^{a_e * d(\vec{e}_i, \hat{\vec{e}}_i) + b_e}} \tag{7}$$

Where $q_1$(i) represents the probability that the $i^{th}$ sub-band is associated with the rule based on untypical energy distribution; $\vec{e}_{in}$ represents the actual energy distribution of the $i^{th}$ sub-band; $\hat{\vec{e}}_\iota$ represents the estimated typical energy distribution of the $i^{th}$ sub-band by traditional panning methods; $d(\vec{e}_\iota, \hat{\vec{e}}_\iota)$ represents the distance between the two energy distributions, which indicates whether the actual energy distribution $\vec{e}_i$ of the $i^{th}$ sub-band is untypical or not; and $a_e$ and $b_e$ represent the parameters of the sigmoid function to map the distance $d(\vec{e}_\iota, \hat{\vec{e}}_\iota)$ to the probability $q_1$(i).

The actual energy distribution $\vec{e}_i$ of the $i^{th}$ sub-band may be measured by well-known methods. To determine the estimated typical energy distribution $\hat{\vec{e}}_\iota$ of the $i^{th}$ sub-band, the spatial position $p_i$ of the $i^{th}$ sub-band may be determined based on the actual energy distribution $\vec{e}_i$. For example, if the energy is distributed the same at the left and right channels, then the spatial position $p_i$ may be the center between the left and right channels. Assuming that the traditional panning methods are used, the $i^{th}$ sub-band may be panned to a channel nearby the spatial position $p_i$ with the estimated typical energy distribution $\hat{\vec{e}}_\iota$. In this way, the typical energy distribution $\hat{\vec{e}}_\iota$ may be determined.

The higher the distance of the two energy distributions is, the higher the probability that the sub-band has untypical energy distribution, which means that the sub-band has less probability to be extracted as an audio object in order to preserve the special artistic intention. In this point of view, the parameter $a_e$ is typically negative. In some embodiments, $a_e$ and $b_e$ may be predetermined and respectively remain the same values for different energy distributions (the actual energy distribution or the determined typical energy distribution). In some other embodiments, $a_e$ and $b_e$ may be respectively a function of the energy distribution (the actual energy distribution or the determined typical energy distribution) or the distance $(\vec{e}_\iota, \hat{\vec{e}}_\iota)$. For example, for different energy distributions or different $d(\vec{e}_\iota, \hat{\vec{e}}_\iota)$, $a_e$ and $b_e$ may have different values.

It should be noted that there are many other ways to determine the degree of association with the rule based on untypical energy distribution besides the above sigmoid function, as long as the degree of association is positively correlated with the distance between the actual energy distribution and the estimated typical energy distribution. The scope of the example embodiment is not limited in this regard.

In some embodiments, the determination of the degree of association with the rule based on vicinity to a center channel may comprise: determining the degree of association with the rule based on vicinity to the center channel according to a second distance between a spatial position of the sub-band of the audio signal and a spatial position of the center channel. In an example embodiment, the degree of association with the rule based on vicinity to a center channel may be represented as a probability, and may be defined as below:

$$q_2(i) = \frac{1}{1 + e^{a_p * d(p_c, p_i) + b_p}} \tag{8}$$

Where $q_2$ (i) represents the probability that the $i^{th}$ sub-band is associated with the rule based on vicinity to a center channel; $p_c$ represents the spatial position of the center channel, which may be predefined; $p_i$ represents the spatial position of the $i^{th}$ sub-band, which may be determined based on Equation (1); $d(p_c,p_i)$ represents the distance between the center channel and the position of the $i^{th}$ sub-band; and $a_p$ and $b_p$ represent the parameters of the sigmoid function to map the distance $d(p_c,p_i)$ to the probability $q_2(i)$.

The smaller the distance $d(p_c,p_i)$ is, the higher the probability that the $i^{th}$ sub-band is associated with the rule based on vicinity to a center channel, which means that this sub-band has less probability to be extracted as an audio object in order to preserve the special artistic intention. In this point of view, the parameter $a_p$ is typically positive. In some embodiments, $a_p$ and $b_p$ may be predetermined and respectively remain the same value for different spatial positions (the center channel position or the position of the $i^{th}$ sub-band). In some other embodiments, $a_p$ and $b_p$ may be respectively a function of the spatial position (the center channel position or the position of the $i^{th}$ sub-band) or the distance $d(p_c,p_i)$. For example, for different spatial positions or different distances $d(p_c,p_i)$, $a_p$ and $b_p$ may have different values.

It should be noted that there are many other ways to determine the degree of association with the rule based on vicinity to a center channel besides the above sigmoid function, as long as the degree of association is negatively correlated with the distance between the center channel position and the position of the $i^{th}$ sub-band. The scope of the example embodiment is not limited in this regard.

The Fourth Probability Based on Frequency Range

Since the extracted audio objects may be reproduced and further played back by various devices with corresponding renderers, it would be beneficial to consider the performance limitation of the renderers during the object extraction. For example, there may be some energy building up when rendering the sub-band with a frequency lower than 200 Hz by various renderers. To avoid introducing the energy build-up, low frequency bands may be favored to be kept in audio beds/residual audio portions during the audio object extraction. Therefore, the frequency range of the sub-band may be used as a factor to estimate the sub-band object probability, and a fourth probability based on frequency band may be determined.

In some example embodiments, to calculate the fourth probability based on frequency range, the following steps may be performed: determining in the frequency range of the sub-band of the audio signal; and determining the fourth probability for the sub-band of the audio signal based on the center frequency. As discussed above, the fourth probability may be positively correlated with the value of the center frequency. That is, the lower the center frequency is, the lower the fourth probability is. The fourth probability is in a range from 0 to 1. It should be noted that, any other frequency in the frequency range of the sub-band may be used instead of the center frequency to estimate the fourth probability, such as, the low boundary, the high boundary, the frequency at ⅓, or ¼ of the frequency range, or any other frequency in the frequency range of the sub-band. In an example, the fourth probability may be determined as below:

$$prob_4(i) = \frac{1}{1 + e^{a_f * f_i + b_f}} \tag{9}$$

Where $prob_4(i)$ represents the fourth probability of the $i^{th}$ sub-band; and $f_i$ represents a frequency in the frequency range of the $i^{th}$ sub-band, which may be the center frequency, the low boundary or the high boundary. For example, if the $i^{th}$ sub-band has a frequency range from 200 Hz to 600 Hz, $f_i$ may be 500 Hz, 200 Hz, or 600 Hz. $a_f$ and $b_f$ represent the parameters of the sigmoid function to map the frequency $f_i$ of the $i^{th}$ sub-band to the fourth probability. Typically, $a_f$ is negative, and then the fourth probability $prob_4(i)$ may be higher as the frequency $f_i$ becomes higher. In some embodiments, $a_f$ and $b_f$ may be predetermined and respectively remain the same value for different value of the frequency $f_i$. In some other embodiments, $a_f$ and $b_f$ may be respectively a function of the frequency $f_i$. For example, for different values of the frequency $f_i$, $a_f$ and $b_f$ may have different values.

It should be noted that there are many other ways to determine the fourth probability based on the frequency range, as long as the fourth probability is positively correlated with some frequency value in the frequency range of the $i^{th}$ sub-band. The scope of the example embodiment is not limited in this regard.

In the above discussion, four probabilities based on four factors are described. The sub-band object probability may be determined based on one or more of the first, second, third, and fourth probabilities.

In some example embodiments disclosed herein, to avoid introducing artifacts and preventing audio instability during audio object extraction, the combined sub-band object probability may be high only in the case that all of the individual factors are high, and it may be low as long as one of the individual factors is low. In one embodiment, the sub-band object probability may be the combination of different factors as follows:

$$prob_{sub-band}(i) = \prod_{k=1}^{K} prob_k(i)^{\alpha_k} \tag{10}$$

Where $prob_{sub-band}(i)$ represents the sub-band object probability of the $i^{th}$ sub-band; K represents the number of factors to be considered in sub-band object probability determination. For example, K may be 4, and all of the above-mentioned four factors are considered. In another example, K may be 3, and three of the above-mentioned four factors are considered. In yet another example, K may be 1, and one of the above-mentioned four factors is considered. $prob_k(i)^{\alpha_k}$ represents the probability based on the $k^{th}$ factor of the $i^{th}$ sub-band; and $\alpha_k$ represents the weighting coefficient corresponding to the $k^{th}$ factor to indicate the "predefined" importance of the $k^{th}$ factor. $\alpha_k$ may be in a range of 0 to 1. In embodiments, $\alpha_k$ may be the same across multiple sub-bands, or may be different for different sub-bands.

It should be noted that, in the sub-band object probability determination, other factors besides or instead of the above discussed four factors may be considered. For example, some clues or information about the audio objects in the audio content provided by the human user may be considered in sub-band object probability determination. The scope of the example embodiment is not limited in this regard.

In method 100, after the sub-band object probability is determined in step S102, the sub-band of the audio signal may be split into an audio object portion and a residual audio portion in step S103, which is also corresponding to the block of audio object/residual audio splitting 203 in FIG. 2. The audio splitting will be described in details below.

In some example embodiments disclosed herein, splitting the sub-band of the audio signal into an audio object portion and a residual audio portion based on the determined sub-band object probability may comprise: determining an object gain of the sub-band of the audio signal based on the sub-band object probability; and splitting each of the plurality of sub-bands of audio signal into the audio object portion and the residual audio portion according to the determined object gain. In one example, each sub-band may be split into an audio object portion and a residual audio portion as follows:

$$x_{obj}(i)=x(i)*g(i)$$

$$x_{res}(i)=x(i)*(1-g(i)) \tag{11}$$

Where x(i) represents the $i^{th}$ sub-band of the input audio content, which may be a time-domain sequence or a frequency-domain sequence; g(i) represents the object gain of the $i^{th}$ sub-band; and $x_{obj}(i)$ and $x_{res}(i)$ represent the audio object portion and residual audio portion of the $i^{th}$ sub-band respectively.

In one example embodiments, determining an object gain of the sub-band of the audio signal based on the sub-band object probability may comprise determining the sub-band object probability as the object gain of the sub-band of the audio signal. That is, the sub-band object probability may be directly used as the object gain, which may be represented as below:

$$g(i)=\text{prob}_{sub\text{-}band}(i) \tag{12}$$

Although the soft splitting directly using the sub-band object probability may avoid some instability or switching artifacts during audio object extraction, the stability of audio object extraction may be further improved since there may still be some noise in the determined sub-band object probability. In some example embodiments disclosed herein, the temporal smoothing and/or the spectral smoothing for the object gain may be proposed to improve the stability of extracted objects.

Temporal Smoothing

In some example embodiments disclosed herein, the object gain of the sub-band may be smoothed with a time related smoothing factor. The temporal smoothing may be performed on each sub-band separately over time, which may be represented as below:

$$\tilde{g}_t(i)=\alpha_t(i)*\tilde{g}_{t-1}(i)+(1-\alpha_t(i))*g_t(i) \tag{13}$$

Where $g_t(i)$ represents the object gain of the $i^{th}$ sub-band in the processing frame t, which may be the determined sub-band object probability of the $i^{th}$ sub-band; $\alpha_t(i)$ represents the time related smoothing factor; and $\tilde{g}_t(i)$ and $\tilde{g}_{t-1}(i)$ represent the smoothed object gain of the $i^{th}$ sub-band in the processing frame t and the frame t−1.

Since the audio objects may appear or disappear frequently over time in each sub-band, especially in the complex final mix content, the time related smoothing factor may be changed correspondingly to avoid smoothing between two different kinds of content, for example, between two different objects or between object and ambience.

Therefore, in some example embodiments disclosed herein, the time related smoothing factor may be associated with appearance and disappearance of an audio object in the sub-band of the audio signal over time. In further embodiments, when at the time an audio object appears or disappears, a small time related smoothing factor may be used, which indicates that the object gain may largely depend on the current processing frame. The object appearance/disappearance information may be determined by sub-band transient detection, for example, the well-known onset probability corresponding to the appearance of an audio object and offset probability corresponding to the disappearance of the audio object. Supposing the transient probability of the $i^{th}$ sub-band in frame t is $TP_t(i)$, in an embodiment, the time related smoothing factor $\alpha_t(i)$ for the spectral-temporal tile may be determined as follows:

$$\alpha_t(i)=TP_t(i)*\alpha_{fast}+(1-TP_t(i))*\alpha_{slow} \tag{14}$$

Where $\alpha_{fast}$ represents the fast smoothing time constant (smoothing factor) with small value, and $\alpha_{slow}$ represents the slow smoothing time constant (smoothing factor) with large value, that is, $\alpha_{fast}$ is smaller than $\alpha_{slow}$. Therefore, according to Equation (14), when the transient probability $TP_t(i)$ is large, which indicates there is a transient point (audio object appearance or disappearance) in the processing frame t, the smoothing factor may be small and then the object gain may largely depend on the current processing frame to avoid smoothing across two different kinds of content. The transient probability $TP_t(i)$ may be 1 if there is audio object appearance or disappearance, and may be 0 if there is no audio object appearance or disappearance in some embodiments. The transient probability $TP_t(i)$ may also be a continuous value between 0 and 1.

There are many other methods that can be used to smooth the object gain. For example, the smoothing factor used to smooth the object gain may be the same across multiple frames or all frames of the input audio content. The scope of the example embodiment is not limited in this regard.

Spectral Smoothing

In some example embodiments disclosed herein, the object gain of the sub-band may be smoothed in a frequency window. In these embodiments, a pre-defined smoothing window may be applied to multiple sub-bands to obtain spectral smoothed gain value:

$$\tilde{g}(i)=\sum_{l=-L}^{L} w_l * g(i+l) \tag{15}$$

Where $\tilde{g}(i)$ represents the object gain of the sub-band i; g(i+l) represents the object gain of the sub-band (i+l), which may be the determined sub-band object probability of the sub-band (i+l); $w_l$ represents the coefficient of the frequency window corresponding to l, which may have a value between 0 to 1; and 2L+1 represents the length of the frequency window, which may be predetermined.

For some kinds of audio content, such as the final mix audio, there may be multiple sources (different objects and ambience) in different spectral regions, smoothing based on the fixed predetermined window may result in smoothing between two different sources in nearby spectral regions. Therefore, in some example embodiments disclosed herein, some spectral segmentation results may be utilized to avoid smoothing over the spectral boundary of two sources, and the length of the frequency window may be associated with a low boundary and a high boundary of the spectral segment of the sub-band. In one embodiment, if the low boundary of the spectral segment is larger than the low boundary of the predetermined frequency window, the low boundary of the spectral segment may be used instead of the low boundary of the predetermined frequency window; and if the high boundary of the spectral segment is smaller than the high boundary of the predetermined frequency window, the high boundary of the spectral segment may be used instead of the high boundary of the predetermined frequency window.

In one example, the smoothed object gain may be determined with the frequency window having the low boundary and the high boundary of the spectral segment of the sub-band considered, and the above Equation (15) may be modified as follows:

$$\tilde{g}(i) = \frac{\sum_{l=max(-L,BL_i-i)}^{min(L,BH_i-i)} w_l * g(i+l)}{\sum_{l=max(-L,BL_i-i)}^{min(L,BH_i-i)} w_l} \tag{16}$$

Where $BL_i$ represents the low boundary of the spectral segment of the sub-band i; and $BH_i$ represents the high boundary of the spectral segment of the sub-band i. The boundaries of the spectral segment may be determined based on the object gain or/and the spectrum similarity of the spectral-temporal tile (the sub-band).

In the sub-band dividing, in order to avoid different objects with different frequency ranges being contained in the same sub-band and the individual objects may not being extracted correctly, the frequency resolution of sub-bands may be high. That is to say, a sub-band has a short frequency range. As mentioned above, the audio object portions and residual audio portions split based on the sub-band object probabilities may be rendered in the adaptive audio content generation or other further audio processing. High frequency resolution may result in a large number of extracted audio object portions, which may pose new challenges for the rendering and the distribution of such content. Therefore, the number of audio object portions may be further reduced by some grouping/clustering approaches in some embodiments.

Figure 5:
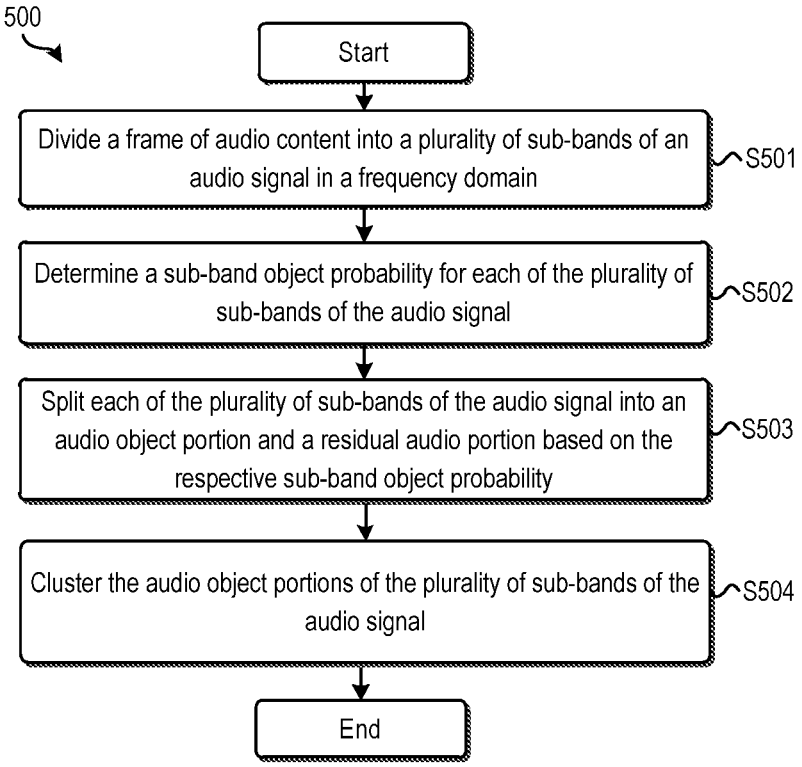
FIG. 5 illustrates a flowchart of a method for audio object extraction in accordance with another example embodiment.

Reference is now made to FIG. 5, which illustrates a flowchart of a method 500 for audio object extraction in accordance with another example embodiment of the example embodiment.

At step S501, a frame of audio content is divided into a plurality of sub-bands of an audio signal in a frequency domain. As mentioned above, considering the sparsity feature of audio objects in audio content, a soft splitting may be perform on a sub-band of the frame of audio content. The number of divided sub-bands and the frequency range of each sub-band are not limited in the example embodiment.

At step S502, a sub-band object probability is determined for each of the plurality of sub-bands of the audio signal. This step is similar to step S101 of the method 100 which has discussed the determination of sub-band object probability. Therefore, the detailed description of this step is omitted here for the sake of clarity.

At step S503, each of the plurality of sub-bands of the audio signal is split into an audio object portion and a residual audio portion based on the respective sub-band object probability. This step is similar to step S102 of the method 100 which has discussed the splitting of a sub-band. Therefore, the detailed description of this step is omitted here for the sake of clarity.

The method 500 proceeds to step S504, and in this step, the audio object portions of the plurality of sub-bands of the audio signal may be clustered. The number of the clustered audio object portions is smaller than the number of the split audio object portions of the plurality of sub-bands of audio signal.

Figure 6:
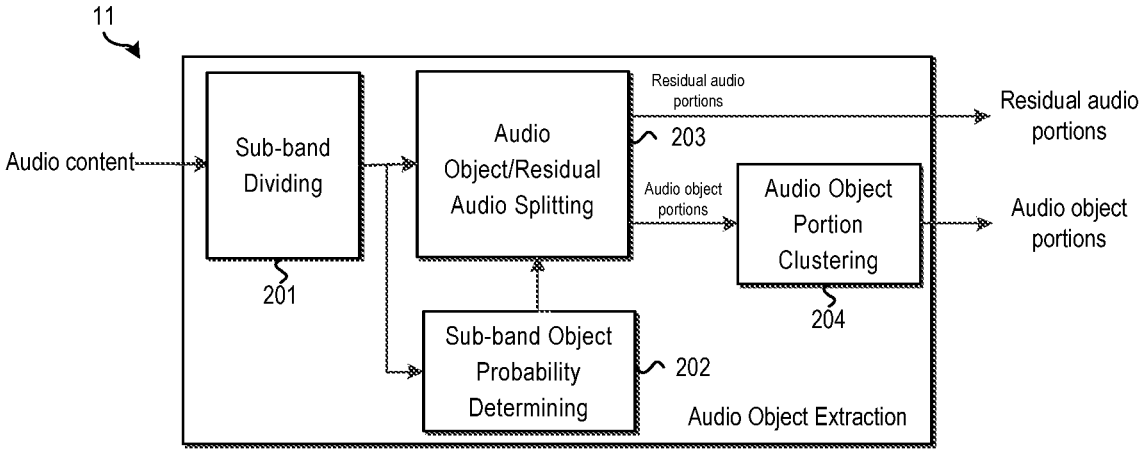
FIG. 6 illustrates a block diagram for audio object extraction in accordance with another example embodiment.

As a result, the block diagram of audio object extraction of FIG. 2 may be modified as the block diagram illustrated at FIG. 6, in which the block of audio object portion clustering 204 is added. The input of block 204 is the split audio object portions from the block 203, and after clustering, the block 204 may output a reduced number of audio object portions.

Various grouping or clustering technologies may be applied to cluster the large number of split audio object portions into a small number of audio object portions. In some embodiments, the clustering of the audio object portions of the plurality of sub-bands of the audio signal may be based on at least one of: critical bands, spatial positions of the audio object portions of the plurality of sub-bands of the audio signal, and perceptual criteria.

Clustering Based on Critical Bands

Based on the auditory masking phenomena of psychoacoustics, it may be hard for humans to perceive an original sound signal when in the presence of a second signal of higher intensity within the same critical band. Therefore, the audio object portions of the plurality of sub-bands may be grouped together based on the critical bands without causing obvious audible problems. The ERB (Equivalent Rectangular Bandwidth) bands may be used to group the audio object portions. The ERB bands may be represented as:

$$ERB(f)=24.7*(4.37*f+1) \tag{17}$$

Where f represents the center frequency of the ERB band in kHz and ERB(f) represents the bandwidth of the ERB band in Hz.

In one embodiment, the audio object portions of different sub-bands may be grouped into the ERB bands based the center frequency (or low boundary, or high boundary) of the sub-bands.

In different embodiments, the number of ERB bands may be preset, for example to 20, which means that the audio object portions of multiple sub-bands of the processing frame may be clustered into the preset number of ERB bands after clustering.

Clustering Based on Spatial Position

An alternative method of sub-band object clustering is based on the spatial position, since the sub-band audio object portion with the same or close spatial position may belong to the same object. Meanwhile, when rendering the extracted audio object portion with obtained spatial positions by various renderers, it may be obvious that rendering the group of sub-bands with a same position may be similar to rendering an individual sub-band with the same position. An example spatial position based hierarchical clustering method is described below.

Step 1: Initialize each audio object portion of multiple sub-bands of the processing frame as an individual cluster.

Step 2: Calculate the spatial distances between every other (or every two) cluster(s).

Step 3: If the cluster number is larger than the target number, merge the two clusters with the minimum distance (or with a distance less than a threshold) as one new cluster based on the spatial position of the two clusters and calculate the spatial position of the merged cluster, then go back to step 2. If the cluster number is equal to the target number, the clustering process may be stopped. In other embodiments, different stopping criteria may be used as well. For example, the clustering process will be stopped when the minimum distance between two clusters is larger than a threshold.

It should be noted that there are many other ways to cluster the audio object portions besides the above described method, and the scope of the example embodiment is not limited in this regard.

Clustering Based on Perceptual Criteria

When the total number of clusters is constrained, clustering the sub-band audio object portions solely based on the spatial position may introduce some artifacts if the audio objects are sparsely distributed. Therefore, clustering based on perceptual criteria may be used to group the sub-band audio object portions in some embodiments. The perceptual criteria may relate to the perceptual factors of audio signal, such as the partial loudness, content semantics or type, and so on. In general, clustering sub-band objects may result in a certain amount of error since not all sub-band objects can maintain spatial fidelity when clustered with other objects, especially in applications where a large number of audio objects are sparsely distributed. Objects with a relatively high perceived importance will be favored in terms of minimizing spatial/perceptual errors with the clustering process. The object importance can be based on perceptual criteria such as partial loudness, which is the perceived loudness of an audio object factoring the masking effects among other audio objects in the scene, and content semantics or type (such as, dialog, music, effects, etc.). Usually, the high (perceived) importance objects may be favored over objects with a low importance in terms of minimizing spatial errors during the grouping process, and may be more probably clustered together. For the low importance object, they may be rendered into the nearby groups of high important objects and/or beds.

Therefore, in some embodiments of the example embodiment, the perceptual importance of each of the multiple audio object portions of a processing frame may be first determined, and then the audio object portions may be clustered based on the perceptual importance measured by perceptual criteria. The perceptual importance of an audio object portion may be determined by combining the perceived loudness (the partial loudness) and content importance of the audio object portion. For example, in an embodiment, content importance may be derived based on a dialog confidence score, and a gain value (in dB) can be determined based on this derived content importance. The loudness or excitation of the audio object portion may then be modified by the determined loudness, with the modified loudness representing the final perceptual importance of the audio object portion.

Figure 7:
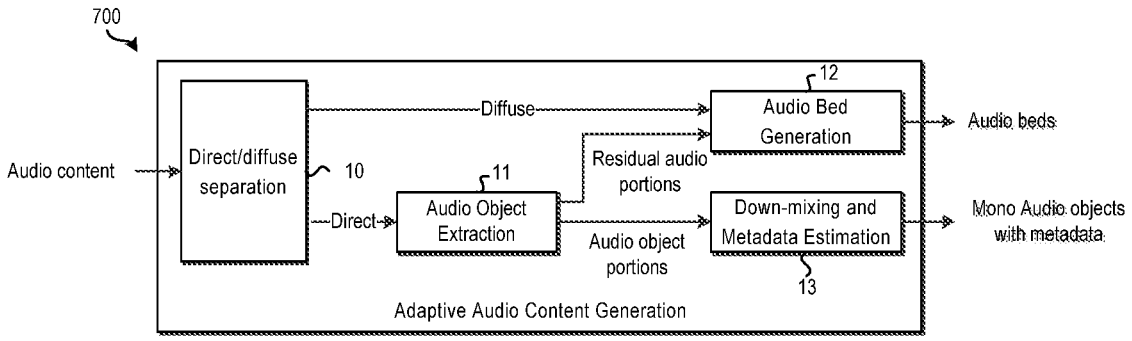
FIG. 7 illustrates a block diagram of a system for adaptive audio content generation in accordance with an example embodiment.

The split (or clustered) audio object portions and residual audio (audio bed) portions may then be used in an adaptive content generation system, where the audio object portions and residual audio (audio bed) portions of the input audio content may be converted to the adaptive audio content (including beds and objects with metadata) to create a 3D audio experience. An example framework of the system 700 is shown in FIG. 7.

The block of direct/diffuse separation 10 in the system 700 may be used to first separate the input audio content into a direct signal and a diffuse signal, where the direct component may mainly contain the audio objects with direction, and the diffuse component may mainly contain the ambiance without direction.

The block of audio object extraction 11 may perform the process of audio object extraction discussed above according to embodiments of the example embodiment. The audio object portions and the residual audio portions may be extracted from the direct signal in this block. Based on some embodiments above, the audio object portions here may be the groups of audio object portions, and the number of groups may depend on the requirements of the system 700.

The block of audio bed generation 12 may be used to combine the diffuse signal as well as the residual audio portions of audio object extraction together to generate the audio beds. To enhance the immersive experience, up-mixing technologies may be applied to this block to create some overhead bed channels.

The block of down-mixing and metadata determination 13 may be used to down-mix the audio object portions into mono audio objects with determined metadata. The metadata may include information for better rendering the audio object content, like the spatial position, velocity, size of the audio object, and/or the like. The metadata may be derived from the audio content by some well-known techniques.

It should be noted that some additional components may be added to the system 700, and one or more blocks of the system 700 shown in the FIG. 7 may be optional. The scope of the example embodiment is not limited in this regard.

The generated adaptive audio content (including the audio beds and mono audio objects with metadata) of the system 700 may be rendered by various kinds of renderers. It may enhance the audio experience in different listening environments, where the audio beds may be rendered to the predefined position, and the audio objects may be rendered based on the determined metadata. The rendered audio content may then be played back by various kinds of speakers, such as sound-boxes, headphones, earphones or the like.

The adaptive audio content generation and its playback are just some example use cases of the audio object portions and residual audio portions generated in the example embodiment, and there may be many other use cases. The scope of the example embodiment is not limited in this regard.

Figure 8:
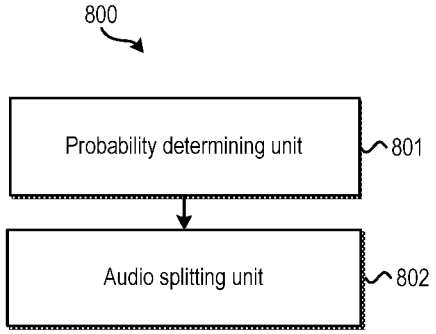
FIG. 8 illustrates a framework of a system for audio object extraction in accordance with an example embodiment.

FIG. 8 shows a block diagram of a system 800 for audio object extraction in accordance with one example embodiment. As shown, the system 800 comprises a probability determining unit 801 configured to determine a sub-band object probability for a sub-band of the audio signal, the sub-band object probability indicating a probability of the sub-band of the audio signal containing an audio object. The system 800 further comprises an audio splitting unit 802 configured to split a sub-band of the audio signal into an audio object portion and a residual audio portion based on the determined sub-band object probability.

In some embodiments, the system 800 may further comprise a frequency band dividing unit configured to divide the frame of the audio content into a plurality of sub-bands of audio signal in a frequency domain. For the plurality of sub-bands of the audio signal, respective sub-band object probabilities may be determined, and wherein each of the plurality of sub-band of the audio signals may be split into an audio object portion and a residual audio portion based on a respective sub-band object probability.

In some embodiments, the determination of the sub-band object probability for each of the plurality of sub-bands of audio signal may be based on at least one of the following:

a first probability determined based on a spatial position of the sub-band of the audio signal; a second probability determined based on correlation between multiple channels of the sub-band of the audio signal when the audio content is of a format based on multiple-channels; a third probability determined based on at least one panning rule in audio mixing; and a fourth probability determined based on a frequency range of the sub-band of the audio signal.

In some embodiments, the determination of the first probability may comprise: determining spatial positions of the plurality of sub-bands of audio signal; determining a sub-band density around the spatial position of the sub-band of the audio signal according to the obtained spatial positions of the plurality of sub-bands of audio signal; and determining the first probability for the sub-band of the audio signal based on the sub-band density, wherein the first probability is positively correlated with the sub-band density.

In some embodiments, the determination of the second probability may comprise: determining a degree of correlation between each two of the multiple channels for the sub-band of the audio signal; obtaining a total degree of correlation between the multiple channels of the sub-band of the audio signal based on the determined degree of correlation; and determining the second probability for the sub-band of the audio signal based on the total degree of correlation, wherein the second probability is positively correlated with the total degree of correlation.

In some embodiments, the determination of the third probability may comprise: determining for the sub-band of the audio signal a degree of association with each of the at least one panning rule in audio mixing, each panning rule indicating a condition where a sub-band of the audio signal is unsuitable to be an audio object; and determining the third probability for the sub-band of the audio signal based on the determined degree of association, wherein the third probability is negatively correlated with the degree of association.

In some embodiments, the at least one panning rule may include at least one of: a rule based on untypical energy distribution and a rule based on vicinity to a center channel. In one embodiment, the determination of the degree of association with the rule based on untypical energy distribution may comprise: determining the degree of association with the rule based on untypical energy distribution according to a first distance between an actual energy distribution and an estimated typical energy distribution of the sub-band of the audio signal. In another embodiment, the determination of the degree of association with the rule based on vicinity to a center channel may comprise: determining the degree of association with the rule based on vicinity to the center channel according to a second distance between a spatial position of the sub-band of the audio signal and a spatial position of the center channel.

In some embodiments, the determination of the fourth probability may comprise: determining a center frequency in the frequency range of the sub-band of the audio signal; and determining the fourth probability for the sub-band of the audio signal based on the center frequency, wherein the fourth probability is positively correlated with the value of the center frequency.

In some embodiments, the audio splitting unit 802 may comprise: an object gain determining unit configured to determine an object gain of the sub-band of the audio signal based on the sub-band object probability. The audio splitting unit 802 may be further configured to split each of the plurality of sub-bands of the audio signal into the audio object portion and the residual audio portion based upon the determined object gain.

In some embodiments, the object gain determining unit may be further configured to determine the sub-band object probability as the object gain of the sub-band of the audio signal. The system 800 may further comprise at least one of: a temporal smoothing unit configured to smooth the object gain of the sub-band of the audio signal with a time related smoothing factor; and a spectral smoothing unit configured to smooth the object gain of the sub-band of the audio signal in a frequency window. In one embodiment, the time related smoothing factor is associated with the appearance and disappearance of an audio object in the sub-band of the audio signal over time. In another embodiment, a length of the frequency window is predetermined or is associated with a low boundary and a high boundary of a spectral segment of the sub-band of the audio signal.

In some embodiments, the system 800 may further comprise: a clustering unit configured to cluster the audio object portions of the plurality of sub-bands of the audio signal, the number of the clustered audio object portions being smaller than the number of the audio object portions of the plurality of sub-bands of the audio signal. In one embodiment, the clustering of the audio object portions of the plurality of sub-bands of the audio signal may be based on at least one of: critical bands, spatial positions of the audio object portions of the plurality of sub-bands of the audio signal, and perceptual criteria.

For the sake of clarity, some optional components of the system 800 are not shown in FIG. 8. However, it should be appreciated that the features as described above with reference to FIGS. 1-7 are all applicable to the system 800. Moreover, the components of the system 800 may be a hardware module or a software unit module. For example, in some embodiments, the system 800 may be implemented partially or completely with software and/or firmware, for example, implemented as a computer program product embodied in a computer readable medium. Alternatively or additionally, the system 800 may be implemented partially or completely based on hardware, for example, as an integrated circuit (IC), an application-specific integrated circuit (ASIC), a system on chip (SOC), a field programmable gate array (FPGA), and so forth. The scope of the example embodiment is not limited in this regard.

Figure 9:
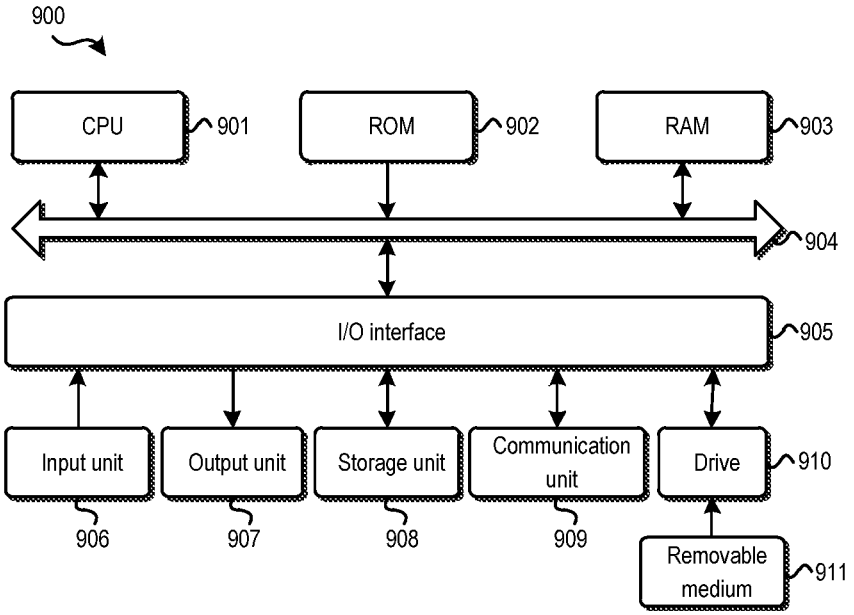
FIG. 9 illustrates a block diagram of an example computer system suitable for implementing embodiments.

FIG. 9 shows a block diagram of an example computer system 900 suitable for implementing embodiments. As shown, the computer system 900 comprises a central processing unit (CPU) 901 which is capable of performing various processes in accordance with a program stored in a read only memory (ROM) 902 or a program loaded from a storage section 908 to a random access memory (RAM) 903. In the RAM 903, data required when the CPU 901 performs the various processes or the like is also stored as required. The CPU 901, the ROM 902 and the RAM 903 are connected to one another via a bus 904. An input/output (I/O) interface 905 is also connected to the bus 904.

The following components are connected to the I/O interface 905: an input section 906 including a keyboard, a mouse, or the like; an output section 907 including a display such as a cathode ray tube (CRT), a liquid crystal display (LCD), or the like, and a loudspeaker or the like; the storage section 908 including a hard disk or the like; and a communication section 909 including a network interface card such as a LAN card, a modem, or the like. The communication section 909 performs a communication process via the network such as the internet. A drive 910 is also connected to the I/O interface 905 as required. A removable medium 911, such as a magnetic disk, an optical disk, a magneto-optical disk, a semiconductor memory, or the like, is mounted on the drive 910 as required, so that a computer program read therefrom is installed into the storage section 908 as required.

Specifically, in accordance with embodiments of the example embodiment, the processes described above with reference to FIGS. 1-7 may be implemented as computer software programs. For example, embodiments comprise a computer program product including a computer program tangibly embodied on a machine readable medium, the computer program including program code for performing methods 100 and/or 500. In such embodiments, the computer program may be downloaded and mounted from the network via the communication section 909, and/or installed from the removable medium 911.

Generally speaking, various example embodiments of the example embodiment may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments of the example embodiment are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, embodiments of the example embodiment include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include but not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the example embodiment may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any embodiment or of what may be claimed, but rather as descriptions of features that may be specific to particular embodiments of particular example embodiments disclosed herein. Certain features that are described in this specification in the context of separate embodiments can also be implemented in combination in a single embodiment. Conversely, various features that are described in the context of a single embodiment can also be implemented in multiple embodiments separately or in any suitable sub-combination.

Various modifications, adaptations to the foregoing example embodiments may become apparent to those skilled in the relevant arts in view of the foregoing description, when read in conjunction with the accompanying drawings. Any and all modifications will still fall within the scope of the non-limiting and example embodiments. Furthermore, other example embodiments disclosed herein set forth herein will come to mind to one skilled in the art to which these embodiments pertain having the benefit of the teachings presented in the foregoing descriptions and the drawings.

Accordingly, the example embodiment may be embodied in any of the forms described herein. For example, the following enumerated example embodiments (EEEs) describe some structures, features, and functionalities of some aspects of the example embodiment.

EEE 1. A method of extracting sub-band objects from multichannel audio comprising:

determining the sub-band object probability;

softly assigning the sub-band to an object or bed/residual audio based on the determined probability; and grouping the individual sub-band objects into several groups.

EEE 2. The method according to EEE 1, wherein the sub-band object probability is determined based on at least one of: position distribution, channel correlation, panning rules, and center frequency.

EEE 3. The method according to EEE 2, wherein the sub-band object probability is positively correlated to the spatial density of sub-band distribution, that is, the higher the spatial density of sub-band distribution is, the higher the sub-band object probability is.

EEE 4. The method according to EEE 3, wherein the sub-band spatial position is determined based on the energy weight of the pre-define channel positions.

EEE 5. The method according to EEE 2, wherein the sub-band object probability is positively correlated to the energy weighted channel correlation, that is, the higher the channel correlation is, the higher the sub-band object probability is.

EEE 6. The method according to EEE 2, wherein the sub-band will be kept in the residual audio if it is associated with one of specific panning rules.

EEE 7. The method according to EEE 6, wherein the specific panning rules include at least one of:

sub-band with untypical energy distribution; and sub-band located in the center channel.

EEE 8. The method according to EEE 2, wherein the sub-band object probability is positively correlated to the sub-band center frequency, that is, the lower the sub-band center frequency is, the lower the sub-band object probability is.

EEE 9. The method according to EEE 1, wherein the sub-band object probability is used as a gain for splitting the sub-band to an object and residual audio.

EEE 10. The method according to EEE 9, wherein both the temporal smoothing and spectral smoothing are used to smooth the sub-band object gain.

EEE 11. The method according to EEE 10, wherein the temporal transient detection is used to calculate the adaptive time constant for temporal smoothing.

EEE 12. The method according to EEE 10, wherein the spectral segmentation is used to calculate the adaptive smoothing window for spectral smoothing.

EEE 13. The method according to EEE 1, wherein the sub-band object grouping method includes at least one of:

critical band based grouping;

spatial position based grouping; and perceptual criteria based grouping.

It will be appreciated that the embodiments of the invention are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method for audio object extraction from audio content, comprising:

determining a sub-band object probability value for a sub-band of an audio signal in a frame of the audio content, the sub-band object probability value indicating a probability of the sub-band of the audio signal containing an audio object; and splitting the sub-band of the audio signal into an audio object portion and a residual audio portion using the determined sub-band object probability value, wherein the determination of the sub-band object probability value for the sub-band of the audio signal is based on at least one of the following:

a) a first probability determined based on a spatial position of the sub-band of the audio signal;

b) a second probability determined based on correlation between multiple channels of the sub-band of the audio signal when the audio content is of a format based on multiple-channels;

c) a third probability determined based on at least one panning rule in audio mixing; or d) a fourth probability determined based on a frequency range of the sub-band of the audio signal; and rendering the audio object portion to estimate a spatial location of the audio object; and rendering the residual audio portion to estimate one or more bed channels of the audio content.

2. The method according to claim 1, further comprising:

dividing the frame of the audio content into a plurality of sub-bands of the audio signal in a frequency domain, wherein, for the plurality of sub-bands of audio signal, respective sub-band object probabilities are determined, and wherein each of the plurality of sub-bands of the audio signal is split into an audio object portion and a residual audio portion based on a respective sub-band object probability.

3. The method according to claim 1, wherein splitting the sub-band of the audio signal into the audio object portion and the residual audio portion based on the determined sub-band object probability comprises:

determining an object gain of the sub-band of the audio signal based on the sub-band object probability; and splitting the sub-band of the audio signal into the audio object portion and the residual audio portion based on the determined object gain.

4. The method according to claim 3, wherein determining the object gain of the sub-band of the audio signal based on the sub-band object probability comprises determining the sub-band object probability as the object gain of the sub-band of the audio signal;

wherein the method further comprises at least one of:

smoothing the object gain of the sub-band of the audio signal with a time related smoothing factor; and smoothing the object gain of the sub-band of the audio signal in a frequency window.

5. The method according to claim 4, wherein the time related smoothing factor is associated with appearance and disappearance of an audio object in the sub-band of the audio signal over time; and wherein a length of the frequency window is predetermined or is associated with a low boundary and a high boundary of a spectral segment of the sub-band of the audio signal.

6. The method according to claim 2, further comprising:

clustering the audio object portions of the plurality of sub-bands of audio signal.

7. The method according to claim 6, wherein the clustering of the audio object portions of the plurality of sub-bands of audio signal is based on at least one of: critical bands, spatial positions of the audio object portions of the plurality of sub-bands of the audio signal, or perceptual criteria.

8. A system for audio object extraction from audio content, comprising:

a probability determining unit configured to determine a sub-band object probability value for a sub-band of an audio signal in a frame of the audio content, the sub-band object probability value indicating a probability of the sub-band of the audio signal containing an audio object; and an audio splitting unit configured to split the sub-band of the audio signal into an audio object portion and a residual audio portion using the determined sub-band object probability value, wherein the determination of the sub-band object probability value for the sub-band of the audio signal is based on at least one of the following:

a) a first probability determined based on a spatial position of the sub-band of the audio signal;

b) a second probability determined based on correlation between multiple channels of the sub-band of the audio signal when the audio content is of a format based on multiple-channels;

c) a third probability determined based on at least one panning rule in audio mixing; or d) a fourth probability determined based on a frequency range of the sub-band of the audio signal; and a rendering unit configured to render the audio object portion to estimate a spatial location of the audio object; and render the residual audio portion to estimate one or more bed channels of the audio content.

9. The system according to claim 8, further comprising:

a frequency band dividing unit configured to divide the frame of the audio content into a plurality of sub-bands of the audio signal in a frequency domain, wherein, for the plurality of sub-bands of the audio signal, respective sub-band object probabilities are determined, and wherein each of the plurality of sub-bands of the audio signal is split into an audio object portion and a residual audio portion based on a respective sub-band object probability.

10. The system according to claim 8, wherein the audio splitting unit comprises:

an object gain determining unit configured to determine an object gain of the sub-band of the audio signal based on the sub-band object probability, wherein the audio splitting unit is further configured to split the sub-band of the audio signal into the audio object portion and the residual audio portion based on the determined object gain.

11. The system according to claim 10, wherein the object gain determining unit is further configured to determine the sub-band object probability as the object gain of the sub-band of the audio signal;

wherein the system further comprises at least one of:

a temporal smoothing unit configured to smooth the object gain of the sub-band of the audio signal with a time related smoothing factor, wherein the time related smoothing factor is associated with appearance and disappearance of an audio object in the sub-band of the audio signal over time; and a spectral smoothing unit configured to smooth the object gain of the sub-band of the audio signal in a frequency window, wherein a length of the frequency window is predetermined or is associated with a low boundary and a high boundary of a spectral segment of the sub-band of the audio signal.

12. The system according to claim 9, further comprising:

a clustering unit configured to cluster the audio object portions of the plurality of sub-bands of audio signal, wherein the clustering of the audio object portions of the plurality of sub-bands of the audio signal is based on at least one of: critical bands, spatial positions of the audio object portions of the plurality of sub-bands of the audio signal, and perceptual criteria.

13. A computer program product, comprising a computer program tangibly embodied on a non-transitory machine readable medium, the computer program containing program code for performing the method of claim 1.

* * * * *